US007350672B1

(12) United States Patent
Gerich

(10) Patent No.: US 7,350,672 B1
(45) Date of Patent: Apr. 1, 2008

(54) FLUID DISPENSING APPARATUS

(76) Inventor: Horst Gerich, 17 Affonso Dr., Carson City, NV (US) 89706

( * ) Notice: Subject to any disclaimer, the term of this patent is extended or adjusted under 35 U.S.C. 154(b) by 424 days.

(21) Appl. No.: 10/956,187

(22) Filed: Sep. 30, 2004

(51) Int. Cl.
*B67D 5/00* (2006.01)

(52) U.S. Cl. ..... 222/137; 222/145.5; 222/135; 137/607; 239/414

(58) Field of Classification Search ..... 222/145.5, 222/145.6, 145.1, 135–137; 137/607; 239/414
See application file for complete search history.

(56) References Cited

U.S. PATENT DOCUMENTS 3,251,508 A 5/1966 Borys
4,019,652 A 4/1977 Suh et al.
4,477,191 A * 10/1984 Ersfeld et al. ..... 366/77
4,789,100 A 12/1988 Senf
5,127,547 A 7/1992 Gerich
5,332,125 A 7/1994 Schmitkons et al.
5,477,988 A 12/1995 Gerich
5,979,794 A 11/1999 DeFillipi et al.
6,564,971 B2 5/2003 Heyes
2004/0056045 A1* 3/2004 Kosmyna et al. ..... 222/95

OTHER PUBLICATIONS

U.S. Appl. No. 10/392,648, filed Mar. 19, 2003, entitled "Fluid Dispensing Apparatus With Check-Valve Operated Mixing Ability", Inventor: Horst Gerich (BSTZ Ref. No. 006489.P001).

* cited by examiner

*Primary Examiner*—J. Casimer Jacyna
(74) *Attorney, Agent, or Firm*—Blakely, Sokoloff, Taylor & Zafman, LLP

(57) ABSTRACT

A manually actuated dispensing gun can deliver different fluids to be mixed. The gun has a body assembly with first and second valves. A lever arm manually actuates the valves. A cap has first and second fluid inlets that are coupled to respective controlled fluid outlets of the valves. The cap has a duct that opens into and runs from a first inlet to a first cap outlet, and another duct that opens into and runs from the second inlet to a second cap outlet without opening into the other duct. One of the ducts has a larger cross-section flow area along its entire length than the other. Other embodiments are also described and claimed.

24 Claims, 7 Drawing Sheets

FIG. 2
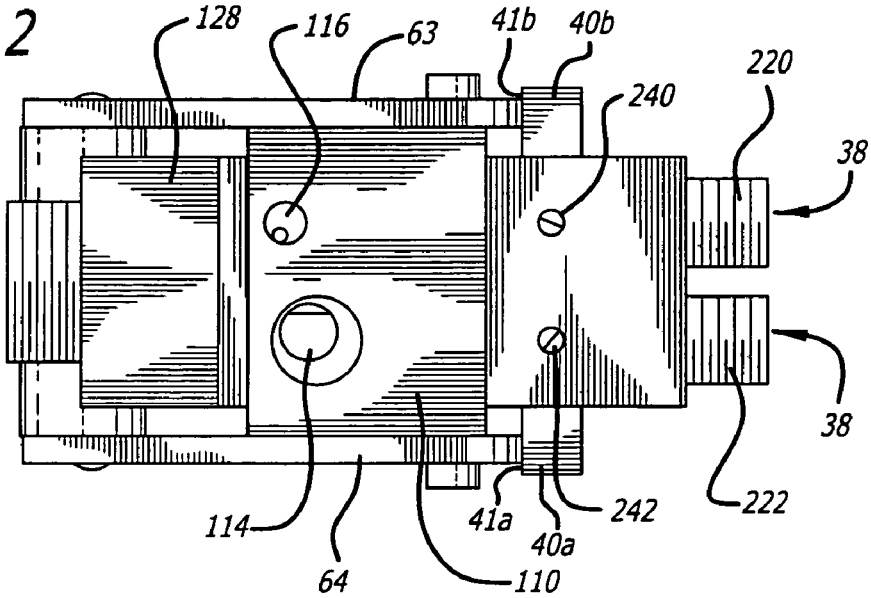
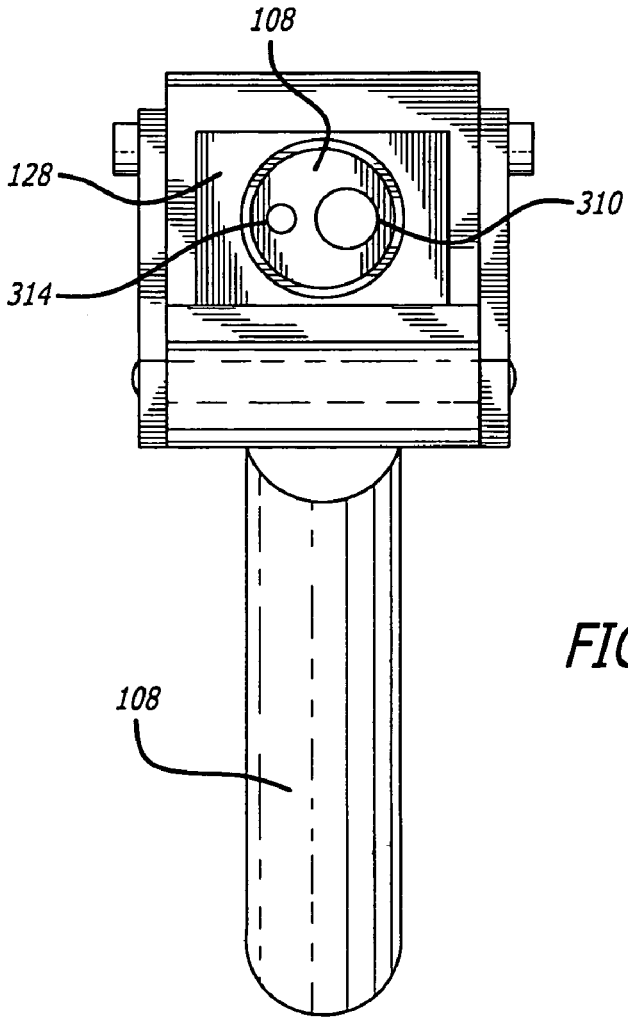
FIG. 3

FLUID DISPENSING APPARATUS

BACKGROUND

The invention is related to equipment used for continuously dispensing two or more fluids in a manner suitable for mixing them, which fluids then react to form, for example, a strong adhesive and/or sealant. More particularly, the invention is related to a dispensing apparatus designed to accurately dispense, for purposes of mixing, at least two reactive fluids that may flow at different pressures and/or have different viscosity.

The mixing of two or more fluids, for purposes of activating bonding and/or sealing properties of the mixture, has many applications. Some of these applications, such as bonding tiles or plates to the fuselage of aircraft or other vehicles in a volume manufacturing setting, require that at least two reactive flows be accurately metered and then mixed continuously. The mixture is applied to one or more of the surfaces that are to be bonded or sealed. In such an application, there may be a relatively thick, first fluid which may be referred to as the base material, that is to be mixed with a relatively thin, second fluid which may be referred to as the catalyst. These two disparate fluids are to be accurately and automatically metered and then mixed, continuously, to yield a desired flow amount of a desired mixture.

A dispensing gun can been used to receive accurately metered amounts of two flows, controllably provide the flows to a mixing structure, and then on to the surfaces to be sealed or bonded. See, e.g., U.S. Pat. Nos. 5,477,988 and 5,127,547 to Gerich. The ideal dispensing gun and metering apparatus should be able to provide a continuous flow of a mixture that has the correct proportions of the two reactive fluids, for as many different types of fluid viscosity and flow pressure. In some cases, the gun is purged after each use, so that no residual amounts of the two reactive fluids remain in contact within the gun (thereby making the gun, but not the mixing structure, essentially reusable).

SUMMARY

A problem has been discovered with the conventional dispensing gun in that, even if the two flows are accurately metered before being delivered to the dispensing gun, this "synchronization" is often lost when the flows emerge from the gun. In addition, if a dispensing gun has been designed to deliver one set of fluids for mixing, and is then redesigned (by changing a size of an orifice, for example) for another set of fluids to be mixed (e.g., having different viscosity than the first set), it is very difficult to re-calibrate the flows so that their mixture has the correct proportions.

According to an embodiment of the invention, a solution to this problem lies in the use of a fluid dispensing gun that features a cap with first and second inlets to receive separate, metered flows of fluid. The cap has a first duct to direct flow from the first inlet to a first outlet, and a second duct that directs flow from the second inlet to a second outlet without communicating with the first duct. The first duct has a larger cross-section flow area than the second duct. These cross-section flow areas may be determined as a function of the expected flow rates of the fluids and/or their respective viscosities. Together with an adjustment mechanism that allows a user to, for example, manually adjust the openings in one or both valves (in the case of a two-component system), such a dispensing gun allows the user to more easily achieve the desired relationship in flow between the two fluids that are emerging from the dispensing gun.

Essentially the same dispensing gun design may be used to dispense and mix different types of component fluids, namely those having differing viscosities and/or flow rates, by simply changing the relationship between the cross-sectional flow areas of the two ducts in the cap. In some cases, there may be no need for a check-valve to help prevent flow of one fluid back into a channel of another fluid, when the flow of the former is at a higher pressure than the latter, as disclosure in U.S. patent application Ser. No. 10/392,648, entitled "Fluid Dispensing Apparatus with Check-Valve Operated Mixing Ability", filed Mar. 19, 2003.

Additional embodiments of the invention will be described below.

BRIEF DESCRIPTION OF THE DRAWINGS

The invention is illustrated by way of example and not by way of limitation in the figures of the accompanying drawings in which like references indicate similar elements. It should be noted that references to "an" embodiment of the invention in this disclosure are not necessarily to the same embodiment, and they mean at least one.

FIG. 2 is a top plan view of the gun.

FIG. 3 is a front elevation view of the gun.

FIG. 10 is a flow diagram of a start-up and running procedure for operating a dual component dispensing gun.

DETAILED DESCRIPTION

Figure 1:
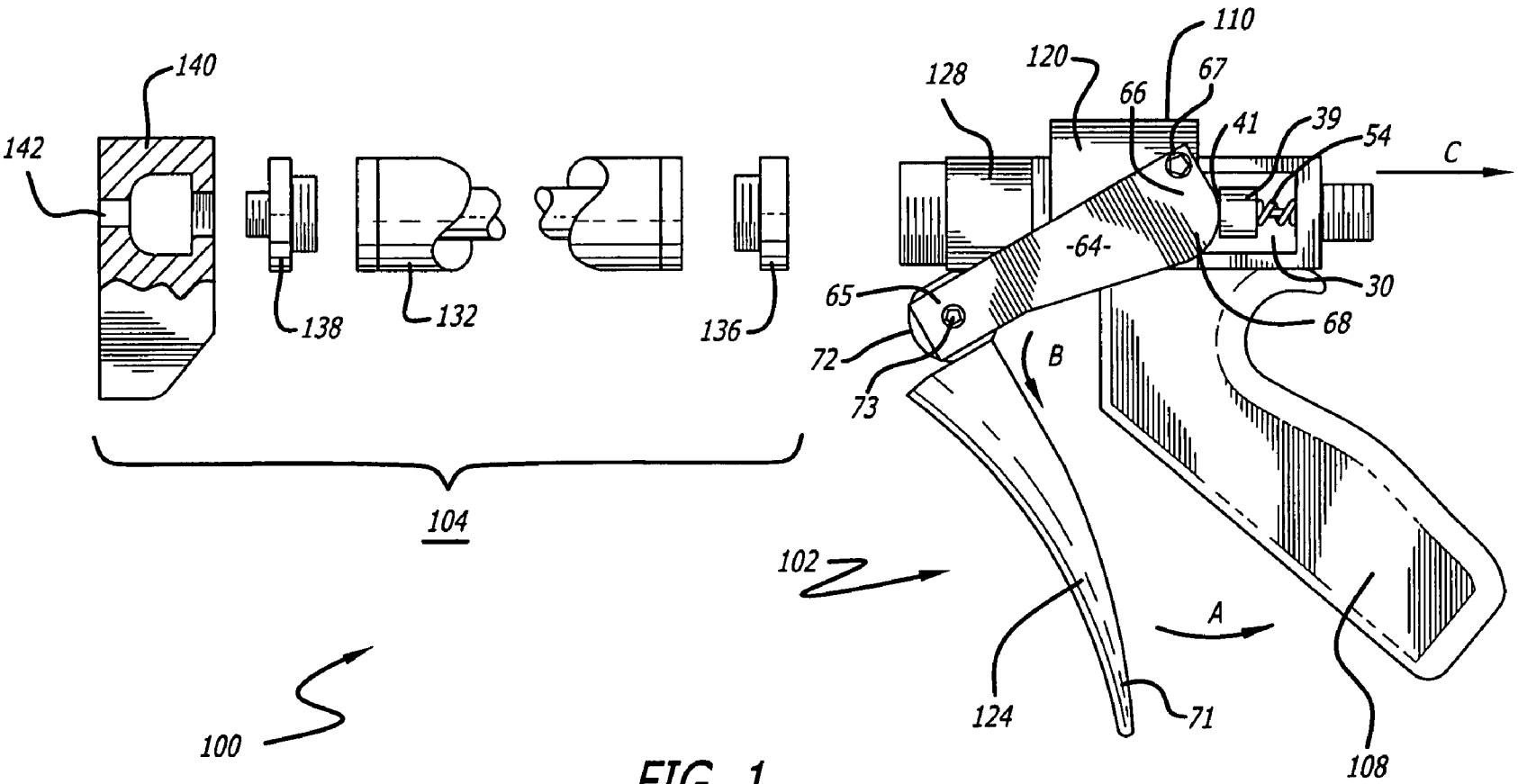
FIG. 1 is an exploded, side elevation view of a dispensing gun assembly, according to an embodiment of the invention.

Beginning with FIG. 1, what is shown is an exploded, side elevation view of an embodiment of the invention as a dispensing gun assembly 100. The assembly 100 is composed of a gun 102 and a mixing and applicator assembly 104. The gun 102 will be described first. The gun 102 in this embodiment is a manually actuated, portable unit having a handle 108 that is located below and secured to a body assembly 110. The handle 108 allows a person to aim the gun assembly 100, and in particular its fluid mixture dispensing outlet (to be described below), to accurately deposit the mixture.

The body assembly 110 has first and second inlets 114, 116 positioned, in this embodiment, on a top face of the body assembly (see FIG. 2) to receive metered flows of two reactive fluids. A pair of valves 120 (not shown in FIG. 1, but to be described below in connection with FIGS. 4 and 5) serves to restrain and allow the two flows. A lever arm 124 is coupled to manually actuate the valves 120. The opening and closing action of the valves 120 may be adjustable, so that, for instance, they can open and close simultaneously as the lever arm is drawn, even with two flows having different viscosity and/or pressures. The adjustment may more generally be needed to calibrate the flows out of the valves according to a predetermined mixture ratio. For example, the adjustment may be needed to intentionally offset the opening (or closing) of the pair of valves as the lever arm 124 is drawn. The adjustment capability may be provided by an adjustable, valve stem biasing arrangement, such as the one described in U.S. Pat. No. 5,477,988.

The gun 102 further includes a cap 128 which is secured to, in this example, the front of the body assembly 110. The cap receives separate, metered flows from the valves 120. In this embodiment, both of the flows emerge from the front face of the cap, through separate outlets (see FIG. 3, outlets 310, 314). Additional aspects of the cap, including the ducts that direct flow from the inlet to the outlet will be described below in connection with FIG. 4.

Still referring to FIG. 1, the mixing and applicator assembly 104 in this embodiment is composed of a shroud-encased mixing structure 132 that is secured to the cap 128 via an adapter 136. The mixing structure 132 serves to thoroughly mix the flow of first and second fluids that have been brought into contact with each other at the cap, so the desired mixture can be formed. The structure 132 may consist of a mixing tube that slidably fits inside a shroud. The shroud containing the mixing tube may then be secured to the cap 128, e.g. via a thread mechanism. The shroud helps keep the structure 132 tightly coupled to the outlet of the cap 128, even in the presence of the high flow pressures mentioned below.

A spreading tool 140 may be coupled to the outlet of the mixing structure 132 via another adapter 138. The tool 140 serves to deliver the desired mixture to a surface to be treated. The desired mixture emerges under pressure from a face of the tool 140. A slot 142 is formed in the face, in a width direction of the tool 140, and fills up with the desired mixture while the face is pressed against the surface to be treated. The tool 140 may then be slid along the surface, to lay a strip of mixture that is as wide as the slot 142. The tool 140 may swivel with respect to the shroud and the mixing structure 132 so that it remains in contact with the surface while the gun is moved along at different angles. In some cases, the tool 140 may be replaced with an adapter (not shown) that allows a cartridge to be filled with the mixture.

Referring now to FIG. 2, what is shown there is a top plan view of the gun 102. The first inlet 114 is larger in this embodiment than the second inlet 116. Note also in this embodiment that the first and second inlets are located on a top face of the body assembly 110. An alternative here would be to locate the inlets 114, 116 on opposing sides of the body assembly 110, without of course interfering with the operation of the lever arm 124 (see FIG. 1). FIG. 2 also shows two movable spring housings 220, 222 extending back from the rear face of the body assembly 110, one for each of the pair of valves 120, used for adjusting the valve stem bias mentioned above.

To manually operate the apparatus from a normally closed disposition to an open position, a pivot plate and lever arm assembly is provided. With reference to FIG. 1, pivot plate 64 is shown having a lever end 65 and a longitudinally spaced-apart actuator end 66. The actuator end is connected to a pivot point 67 on a respective lateral side wall of the valve portion. The actuator end further includes a cam portion 68 which is offset from the pivot point a distance sufficient to engage the cam abutment surface 41.

Secured to lever end 65 of the pivot plate is lever arm 124. The lever arm extends downwardly from the pivot plate into an area proximate the handle 108 of the valve body. The distance between the lever arm free end and handle portion should not be greater than the distance that a user can manually grasp both the handle portion and lever arm together with one hand.

The lever arm is securely attached to the pivot plate so that drawing the free end 71 toward the handle portion, as shown by arrow A in FIG. 1, will result in a downward movement of the pivot plate as shown by arrow B. This will cause cam portion 68 to move outwardly and push against the cam bar abutment surface 41. Such action results in an axial displacement of the combined cam bar and valve stem as shown by arrow C. The axial displacement will likewise compress spring member 54. When the lever arm is released, the compressed spring member will force the cam bar back against the cam portion 68 and cause the pivot plate to rotate back upwardly to its closed at rest position.

In the dual channel mode, the corresponding pivot plates 64, 63 (see FIG. 2) and valve stems move precisely in unison so that the exact amounts of materials will be dispensed and ultimately combined in a downstream mixer. This, of course, is not a problem since the rigid cam bar 39 will actuate both flow channels simultaneously. In this variation, the invention comprehends the addition of a tie bar 72 for interconnecting both of the opposing pivot plates. As shown in FIG. 1, the tie bar is fixedly attached to the lever end of each respective pivot plate with tie fasteners 73. The lever arm will then be connected to the mid-point of the tie bar with an arm fastener (not shown). Consequently, an operator will still only need to grasp a single leer arm to actuate and precisely dispense two streams of fluids with one movement of the arm.

Connected to the actuator portion of the valve stem is cam bar 39. The cam bar is positioned within interior chamber 30 (FIG. 1) and has sufficient width to extend laterally outward through a respective lateral side opening beyond the plane of a respective lateral side wall. When the apparatus comprises a dual channel system, it is preferred that both ends of the cam bar be extended and utilized as cam abutment surfaces. In FIG. 2, the sections of the cam bar that extend beyond the aforesaid said walls are shown by references 40*a,b*. These sections provide the cam abutment surfaces 41*a,b*.

Turning now to FIG. 3, a front elevation view of the gun 102 is shown. In this example, on a front face of the cap 128 are formed an outlet 314 and a larger outlet 310.

Figure 4:
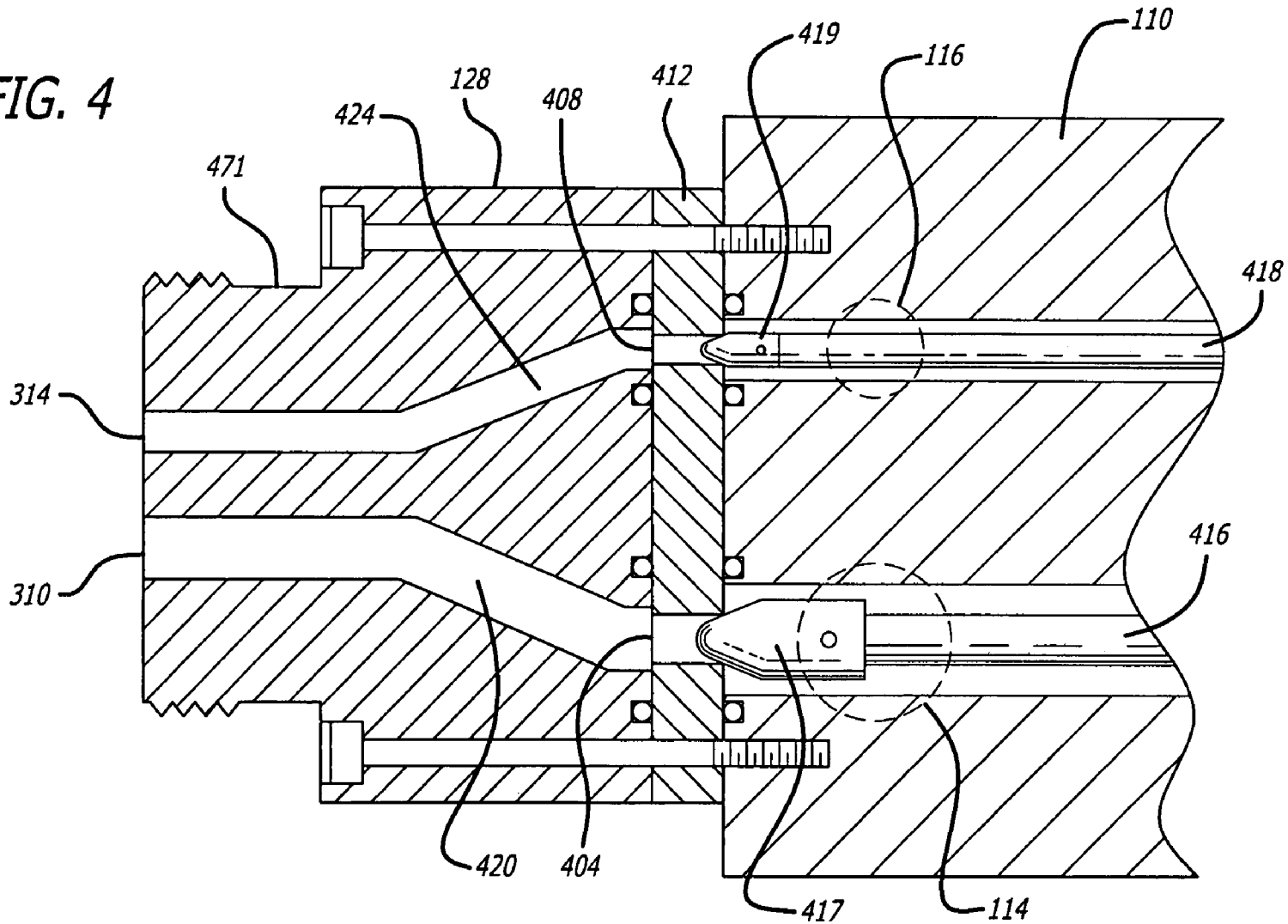
FIG. 4 is a cross-section view of the body assembly and cap of the gun.

FIG. 4 shows a cross-section of the body assembly 110 and the cap 128, as well as a portion of the valves 120 in some detail. See also FIG. 5, which depicts an exploded, isometric view of those same parts. The cap 128 has first and second inlets 404, 408 to receive separate, metered flows of fluid, via first and second outlets positioned on a front face of the body assembly 110. In this embodiment, a removable plate 412 is provided between the cap 128 and the body assembly 110 and on which the outlets and the valve seats of the pair of valves 120 are formed. This may render the gun 102 more serviceable, as the valve seats may be a greater wear item than other parts of the gun 102. FIG. 4 also shows the stems 416 and 418 of the valves 120. The stems 416, 418 are biased into the closed position shown, using springs (not shown) at the rear of the body assembly 110. Note how the larger stem 416 has a smaller diameter than its head 417. This design may help close the valve with a smaller spring, thereby rendering manual operation of the valves 120 less strenuous. Also, to help improve the sealing properties of the valves 120 in the presence of slight misalignment of the stem 416, 418, the heads 417, 419 may be "floating", e.g. via a pivoting attachment between the heads 417, 419 and the body of stems 416, 418. Seals, in particular O-rings, may be used between the cap 128 and the plate 412, and between the plate 412 and the main section of the body assembly 110, to prevent leaks of the first and second fluids. Additional details of such a valve can be found in U.S. Pat. No. 5,477,988.

Various means for adjustably attaching a valve stem to the cam bar can be used such as an open slot or clamping means. When the stem is inserted through stem aperture, means such as set screws, lock collars and/or opposing lock nuts can be used. As shown, the preferred embodiment simply utilizes a threaded stem aperture which adjustably engages corresponding external threads along a predetermined section of the actuator position. Longitudinal adjustment can thereby be accomplished simply by rotation of the valve stem via an implement engagement end 38. As shown in FIG. 2, the engagement end 38 comprises a screwdriver slot. An allen wrench opening or socket engagement structure could also be used.

To ensure that the overall device is always disposed in a closed non-flow position when not in use, a biasing adjustment means is provided. This means is connected to the stem housing for the purpose of continuously urging the valve stem terminal end portion into sealing engagement with the valve opening.

The biasing adjustment means comprises a spring housing having an abutment part. The housing is adjustably connected to the biasing adjustment opening. A spring member 54 is interposed between the abutment part and the cam bar. As best shown in FIG. 1, the spring housing comprises a tube structure having external threads for engagement with corresponding threads in the adjustment opening. The outer end of the tube is provided with the abutment part comprising open cap. The outer diameter of the spring member is less than the tube inner diameter so that the spring will extend within the tube structure and abut against the inner edges of the end cap.

To increase or decrease the amount of compression force against the cam bar and valve stem, the spring adjustment part is simply rotated about its threaded engagement to move it inwardly or outwardly as desired. To accomplish this, an adjustment slot at the distal end of the cap end is provide for engagement with a screwdriver or the like.

The end cap has a central opening except for the annular thickness of the cap itself. This structure and the open coil structure of the spring member, permit insertion of an implement through the interior of the spring housing for accessing slot of the valve stem. As such, the valve stem can be rotated for longitudinal adjustment without dismantling the entire stem housing assembly.

It will also be appreciated that the lateral position of the valve stem can be securely fixed against inadvertent movement by the use of set screws 240, 242. These may alternatively extend through corresponding openings on opposing edges of the cam bar sections and engage the actuator portion of the valve stem. This advantage is possible because of the U-shaped stem housing structure and the relative positioning of the cam bar.

Figure 5:
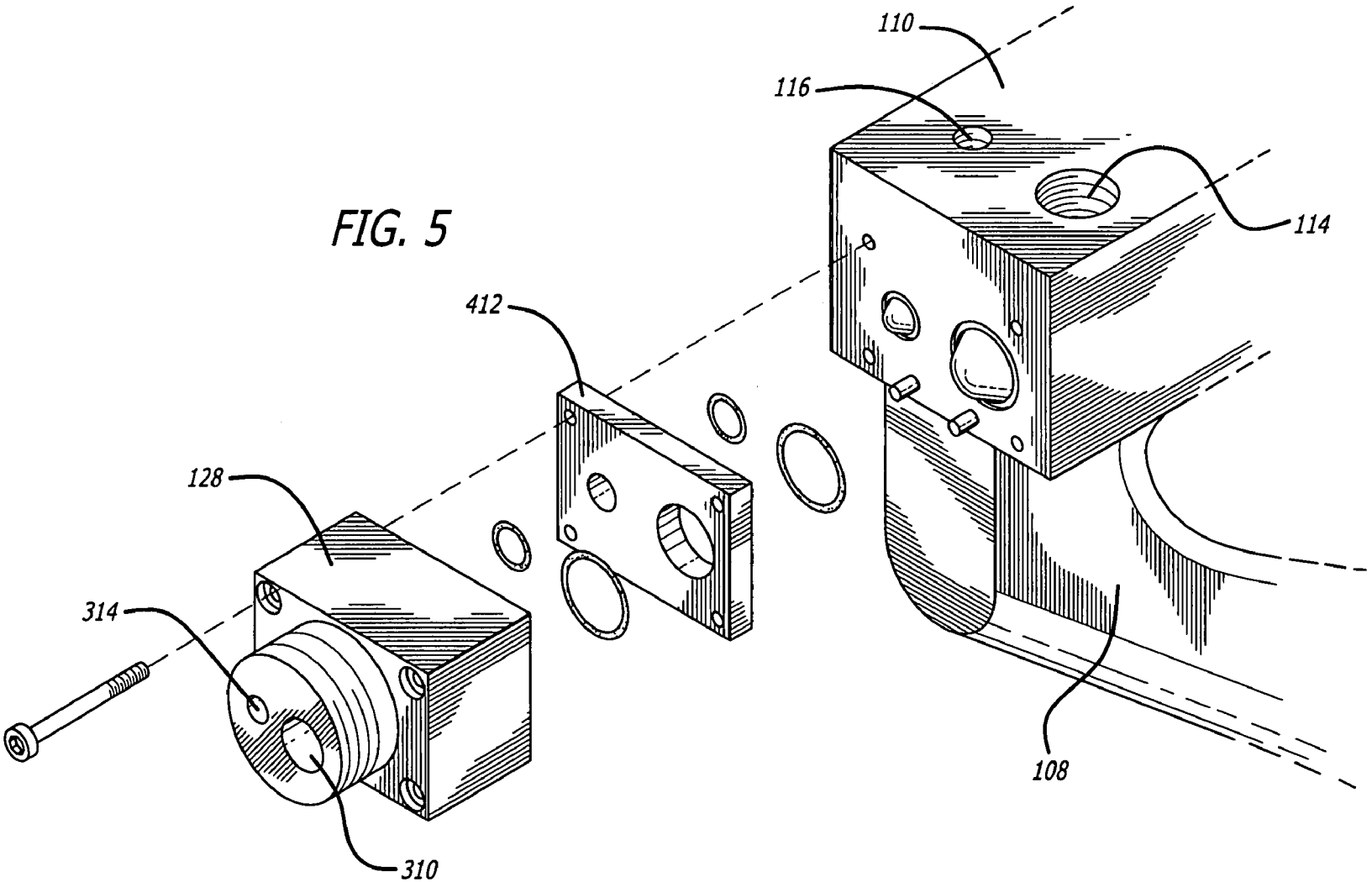
FIG. 5 is an exploded, isometric view of the body assembly and cap.

FIGS. 4 and 5 show different views of the same cap and body assembly of the gun. A first duct 420 in the cap 128 directs flow from the first inlet 404 to the outlet 310 (see also FIG. 3). A second duct 424 directs flow from the second inlet 408 to another outlet 314. Note how the cross-section flow area of the first duct 420 is larger along the entire path from the inlet to the outlet, than that of the second duct 424. This feature helps ensure that the flows emerge at the outlets 310, 314 at essentially the same point in time, following the initial activation of the gun by, in this example, squeezing a lever to move the valve stems 416, 418 back (that is, to the right as shown in FIG. 4). So designed, the cap 128 and the removable plate 412 may be separate, relatively low cost, disposable pieces. In this way, the gun assembly 100 need not provide a purging mechanism, which is typically used to purge one or both of the fluid channels in the gun assembly of any residual amounts of the two fluids. Some type of purging is typically needed if a gun is to be reusable flowing a long period of non-use, because otherwise, the residue of the two fluids could come into contact with each other and thus react inside the gun assembly 100, thereby causing the gun to cease. As an alternative, however, the cap and removable plate may be integrally formed, that is machined out of the same piece of metal as, for example, the body assembly 110.

Figure 6:
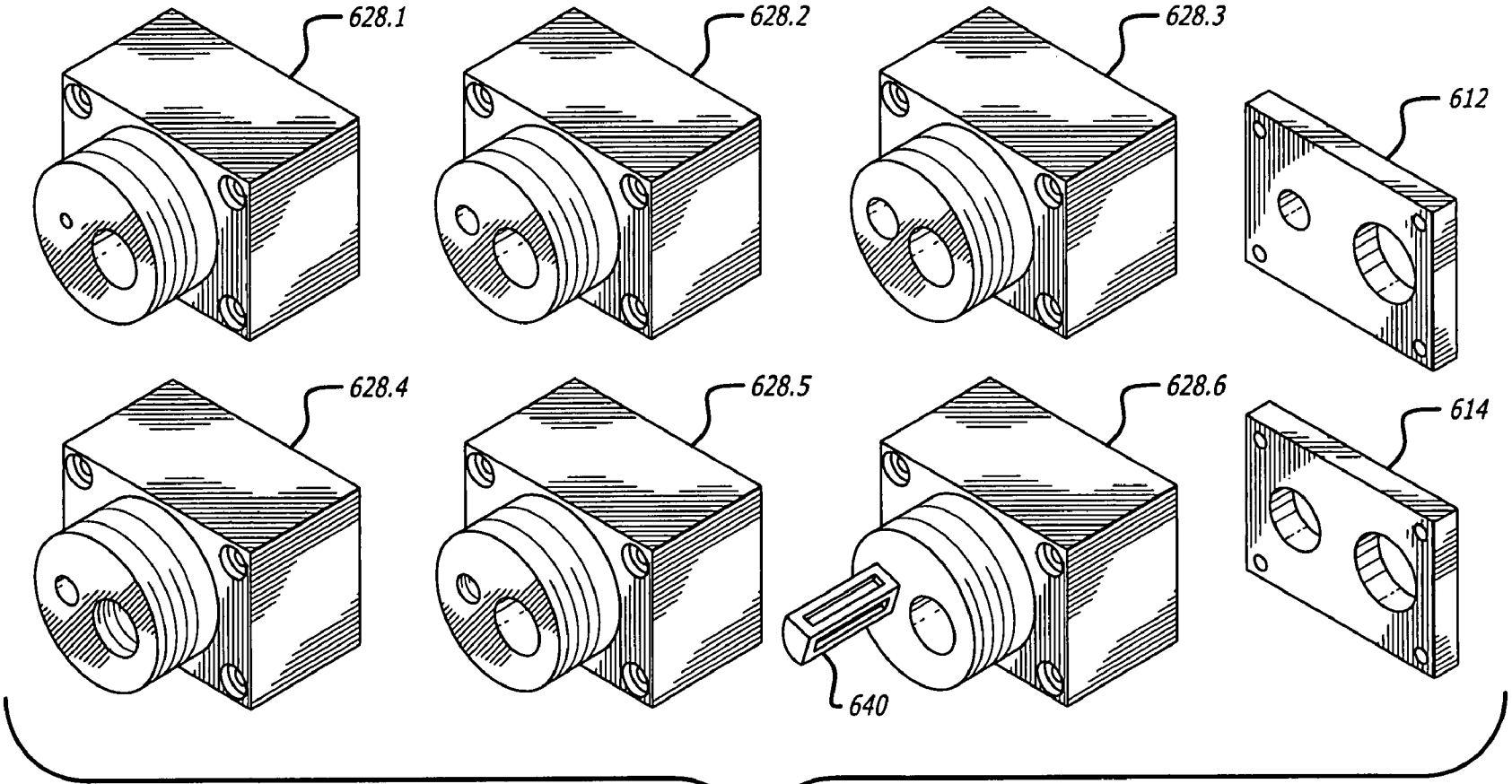
FIG. 6 depicts a number of different caps, each with a different relationship in the cross-sectional areas of the first and second ducts.

As mentioned above, to reuse the gun with fluids that have a different viscosity or flow characteristics, the gun may be redesigned by simply changing the cross-section flow area of at least one of the two ducts in the cap. For example, the duct used for the base material may be kept unchanged for a range of different, multi-component adhesives, and only the duct used for the catalyst can be varied depending on the particular adhesive to be used. In addition, it may be expected that when a change to the size of the ducts is made, a corresponding change to the outlets and valve seats of the pair of valves 120, as formed in the removable plate 412 (see FIG. 4), should be made. This is depicted in FIG. 6 in which two different removable plates 612, 614 are shown, each having a different relationship between the cross-sectional flow areas of their respective valve seats, to be used with six different caps 628_1 . . . 628_6. Each cap 628 has a cylindrical piece in which the ducts are formed in the direction of a longitudinal axis of that piece. The piece is externally threaded in the direction of the longitudinal axis, so that a cap adapter 136, or alternatively the mixing tube 132, may be screwed thereon (see FIG. 1).

Figure 7:
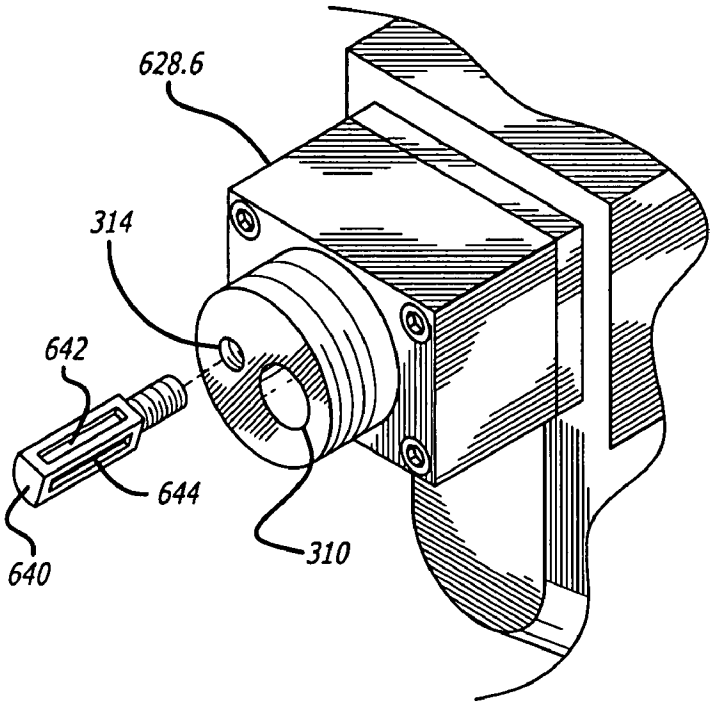
FIG. 7 illustrates an example outlet adapter being installed onto the cap.

FIG. 6 also depicts a cap 628_6, according to another embodiment of the invention, where the second outlet 314 (see FIG. 4, for example) is internally threaded to receive an outlet adapter 640. FIG. 7 illustrates an example technique for installing such an outlet adapter 640. A far end of the outlet adapter 640 is threaded to match the internal thread of the outlet 314 in the cap, while towards the near end a pair of slots 642, 644 are formed in the longitudinal direction, as shown, through which the fluid emerges upon activation of the dispensing gun. The slots are positioned and shaped such that they change the direction of the flow of the second fluid that would otherwise emerge perpendicular to the face of the cap 628_6 from the second outlet 314. Use of this adapter 640 has been found to be particularly effective in helping form a thorough mixture of a silicon base for the first fluid, and silicon catalyst for the second fluid (emerging from the outlet adapter 640) known as Proglaze™ II, a multi-component structural silicon sealant by Tremco Sealants, Beachwood, Ohio.

Figure 8:
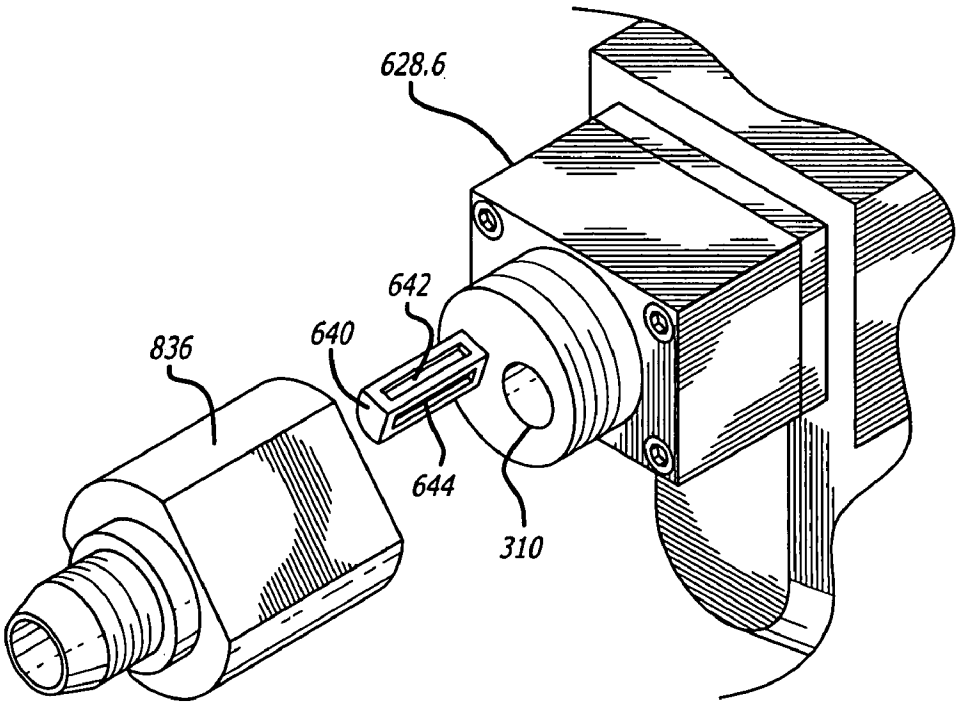
FIG. 8 shows the outlet adapter, as installed on the cap, and about to be enclosed by a special cap adapter.

FIG. 8 shows the outlet adapter 640 as installed on the face of the cap 628_6. Note that as installed, the slots 642, 644 should be oriented to open towards the flow of the first fluid emerging from the first outlet 310. This may be achieved by, for example, ensuring that the size and count of the threads in the far end of the adapter 640 are accurately designed and manufactured so that the orientation is substantially as shown in FIG. 8 once the adapter 640 has been screwed into its fixed position. Note that in this embodiment, an enlargened cap adapter 836 that has been lengthened to accommodate the extra length of the outlet adapter 640 may be screwed onto the cap 628_6.

Figure 9:
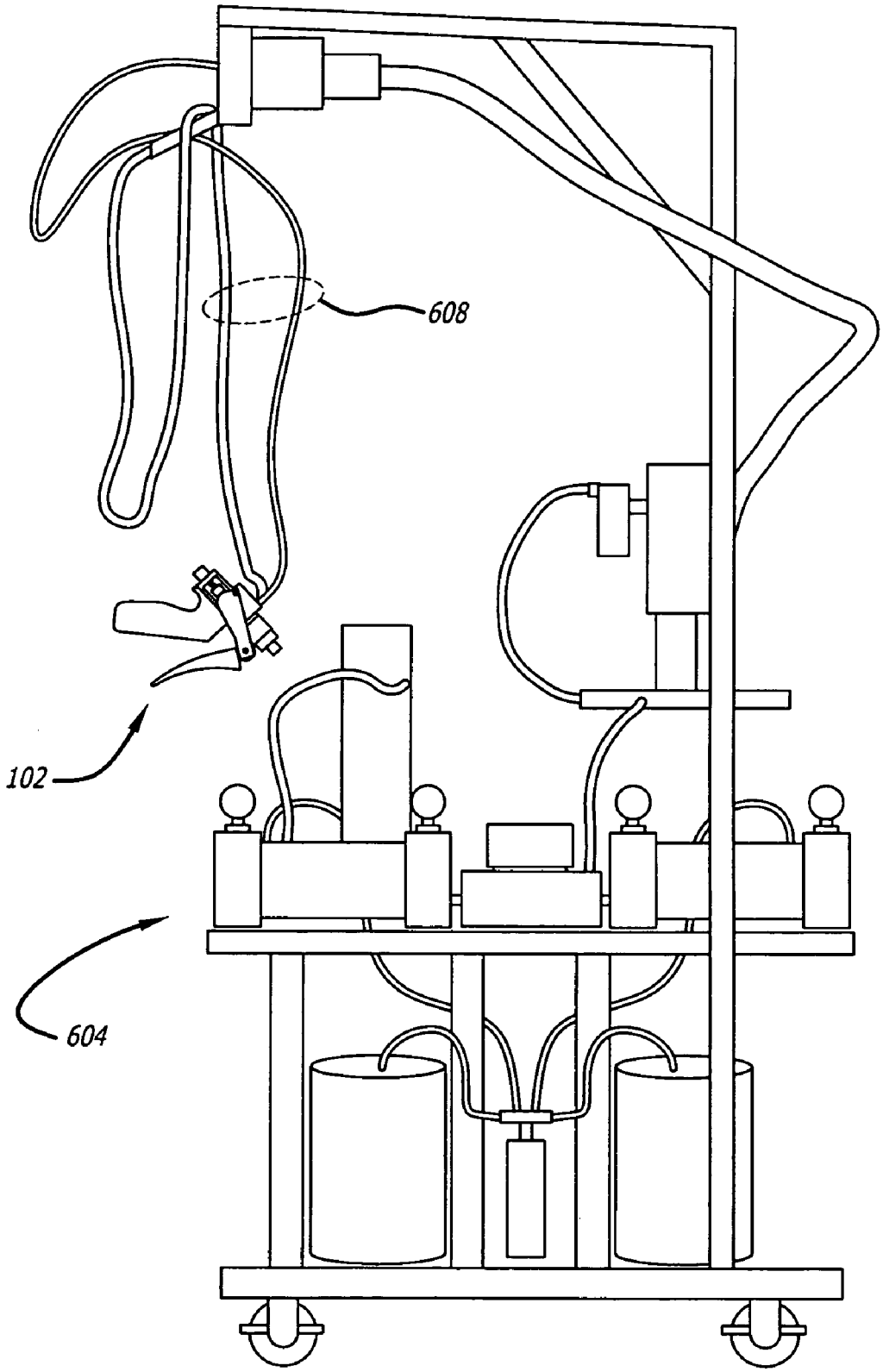
FIG. 9 depicts an automatic fluid metering and dispensing system.

The dispensing gun assembly 100 described above may be part of an automatic fluid metering and dispensing system 600, as shown in FIG. 9. An automatic metering mechanism 604 provides the metered flows of the first and second fluids to the dispensing gun assembly 100 via a pair of hoses 608. See U.S. Pat. No. 5,127,547 for an example of the metering mechanism 604. According to an embodiment of the invention, the metering mechanism 604 and gun assembly 100 are designed to work with a first fluid that is significantly thicker than the second fluid. Just as an example, the first fluid may be a base material having a viscosity in the range of that of tar, whereas the second fluid may be a catalyst whose viscosity is in the range of that of water or automobile motor oils. The proportions of the base material to the catalyst may also vary, for example from 12:1 to 5:1, and will be maintained at the output of the metering mechanism 604 automatically at pressures of, for example, in the range of 100 to 3000 psi, preferably greater than 1000 psi. The dispensing gun assembly 100 described above may further ensure such proportions, into and out of the mixing structure, to more closely meet the desired mixture.

A flow diagram of a start-up and running procedure for operating a dual component dispensing gun, such as one of those described above is described. Operation begins with removing a protective cover from the front face of the cap 128. At this point, the dispensing gun should be coupled to the metering apparatus by, for example, flexible hoses that bring the base and catalyst into the body assembly of the gun. The gun should preferably be designed such that when the lever 124 is not pressed, the valves remain closed. With the metering apparatus being "turned on", and thereby causing the flow of the first and second fluids to start, the lever 124 is squeezed by the user's hand until both the base and catalyst fluids appear at the outlets 310, 314 of the cap 128. If both of these materials do not emerge at the same time, or if the gun tends to seep when the lever has been released into the valve closed position, then a gun adjustment procedure, such as the one described below, should be performed before proceeding with using the gun for dispensing the mixture.

If the fluid seeps out of either port when the lever has been released into the valve closed position, or if the fluids do not emerge simultaneously, then a valve adjustment procedure is performed. In this example, a set screw 240 or 242 that is located on the side of the seepage should first be loosened to release the moveable spring housing 220, 222 (see FIG. 2). Then, the moveable spring housing 220 or 222 should be turned in the direction that moves its valve stem towards the valve seat. The gun lever 124 (trigger) may then be squeezed and released, to see if the seepage has stopped. If not, the spring housing 220 or 222 should be further rotated, and the seepage evaluation should be repeated. Finally, once the seepage has stopped, the set screw may be retightened to ensure that the calibrated position of the housing 220 or 222 is not disturbed during normal operation.

According to another embodiment of the invention, a fine adjustment procedure may be followed to further adjust the dispensing. After running the fluids through the gun, if it should be visually determined that the fluids do not emerge simultaneously from the outlets of the end cap, or if, for example, the base fluid overtakes the catalyst, then the following procedure should be performed. First, the user lets go of the lever arm 124, so that flow out of the gun should stop or at least slow down to a very slow seepage. Next, determine which of the two fluids (for the dual channel embodiment) is "ahead" of the other, and then place a shim between the cam bar 39 and the cam portion 68 of the pivot plate 63 or 64, whichever is on the side opposite to the one with the fluid being ahead. For example, referring now to FIG. 2, if the fluid at inlet 114 is ahead of the fluid at inlet 116 (as determined, for example, by looking at the fluids emerging from their respective outlets 310, 314 as seen in FIG. 3), then the shim is placed against the cam abutment surface 41*b*, instead of the abutment surface 41*a*. Thereafter, this modification may be evaluated by squeezing the trigger and evaluating the flow at the outlets and adding additional shims, if needed, to equalize the emerging fluids.

Resuming now with the start-up and running procedure, if the gun operates acceptably in that it does not seep when the lever has been released, then the mixer may be prepared by, for example, inserting a mixing structure into its shroud and screwing the shroud onto a cap adapter. The cap adapter may be one that allows a pre-mixer to be inserted therein, thus helping promote earlier mixing of the components. The adapter, including the pre-mixer and the shroud attached to it, may then be screwed onto the cap 128 of the dispensing gun. The gun is now ready for use in delivering the mixture at the outlet of the mixing tube.

As described above, in some cases, a nozzle adapter may be fitted onto the far end of the shroud, where this nozzle adapter may, for example, allow for a particular type of nozzle to be used in obtaining a desired shape of the mixture on the surface to be treated with the fluid mixture.

ALTERNATIVE EMBODIMENTS

Although the components of the gun assembly 100 may be designed to operate within the preferred range of fluid viscosity and flow pressures, as explained using examples above, the design of the gun assembly 100 and the metering mechanism 604 is not limited to fluids only in those ranges.

Also, the dispensing apparatus has been characterized as being made of a number of parts, such as the body assembly, plate, cap, and handle. In practice, at least some of these parts may be integrated (e.g., the handle may be machined out of the same piece of metal as the body assembly), for either manufacturing reasons or to lower the overall cost of producing the gun and/or operating it. Others such as adapters may not be needed at all.

Another alternative to the above-described embodiment of the gun assembly is the use of a powered actuation mechanism, e.g. pneumatic or electromechanical actuators, instead of the hand-powered lever arm. The powered actuation alternative might also be useful in robotic applications of the dispensing gun for very high volume manufacturing assembly lines.

To summarize, various embodiments of a gun used for continuously dispensing two or more fluids in a manner suitable for mixing them, which fluids then react to form, for example, a strong adhesive and/or sealant have been described. In the foregoing specification, the invention has been described with reference to specific exemplary embodiments thereof. It will, however, be evident that various modifications and changes may be made thereto without departing from the broader spirit and scope of the invention as set forth in the appended claims. For example, although the above description has focused on the dual channel embodiment of the invention, the invention may be used not just in binary mixing applications but also with applications that call for more than two fluids to be metered and mixed properly. In that case, the dispensing apparatus described above could be fitted with additional fluid channels. The specification and drawings are, accordingly, to be regarded in an illustrative rather than a restrictive sense.

What is claimed is:

1. A fluid dispensing apparatus comprising:

a cap with first and second inlets to receive separate, metered flows of fluid, the cap having a first duct that directs flow from the first inlet to a first outlet, and a second duct that directs flow from the second inlet to a second outlet without communicating with the first duct, wherein the first duct has a larger cross-section flow area than the second duct;

a body assembly having first and second valves that feed first and second outlets positioned on a front face of the assembly and to which the first and second inlets of the cap, respectively, are coupled; and a removable plate to be positioned between the front face of the body assembly and the cap and on which first and second valve seats for the first and second valves, respectively, are formed.

2. The apparatus of claim 1 wherein the cap has a front face on which the first and second outlets of the cap are formed.

3. The apparatus of claim 2 wherein the cap is threaded on its outer surface to couple the first and second outlets of the cap to an inlet of a mixing structure.

4. The apparatus of claim 1 wherein the cap is a separate, disposable piece.

5. The apparatus of claim 1 wherein the body assembly has a top face and a pair of opposing side faces the body assembly further includes first and second inlets positioned on the top face and that feed the first and second valves, respectively.

6. The apparatus of claim 1 wherein the body assembly has a top face and a pair of opposing side faces the body assembly further includes a first inlet positioned on one of the side faces and a second inlet positioned on another one of the side faces and that feed the first and second valves, respectively.

7. The apparatus of claim 1 wherein the first valve seat has a larger cross-section flow area than the second valve seat.

8. The apparatus of claim 7 wherein the first and second valves have first and second valve stems with first and second floating heads, respectively.

9. The apparatus of claim 8 further comprising:

a handle coupled to the body assembly.

10. The apparatus of claim 2 wherein the second outlet is internally threaded to receive an outlet adapter that is shaped to change the direction of the flow of the second fluid.

11. The apparatus of claim 1 wherein the cross-section flow areas have been predetermined as a function of expected flow rates of the first and second fluids.

12. The apparatus of claim 10 further comprising a cap adapter that is to be screwed onto the cap enclosing the outlet adapter.

13. The apparatus of claim 12 further comprising a mixing tube having an inlet coupled to the cap adapter, to mix said first and second fluids received from the cap adapter.

14. The apparatus of claim 13 further comprising a pre-mixer structure inside the cap adapter.

15. The apparatus of claim 1 further comprising:

a mixing tube having an inlet coupled to the cap, to mix said first and second fluids received from the cap.

16. The apparatus of claim 15 further comprising:

a shroud in which the mixing tube is inserted, the shroud having an outlet that is to receive said mixed flow from an outlet of the mixing tube, the shroud having an inlet end that is to be secured to the cap.

17. The apparatus of claim 16 further comprising:

a cap adapter to be coupled between the shroud and the cap.

18. The apparatus of claim 9 wherein the body assembly has a cam bar to which one of said valve stems is coupled by a screw mechanism for adjusting a position of said valve stem in a longitudinal direction relative to the cam bar, the cam bar being spring loaded to bias said valve stem against its respective valve seat.

19. A fluid metering and dispensing system, comprising:

a metering mechanism to provide metered flows of first and second fluids through first and second outlets, respectively, the first fluid being more viscous than the second fluid; and a plurality of caps each with first and second inlets, each cap having a first duct that directs flow from the first inlet to a first outlet, and a second duct that directs flow from the second inlet to a second outlet without communicating with the first duct, wherein the first duct has a larger cross-section flow area than the second duct, wherein a cross-section flow area relationship between the first and second ducts of each cap is different, each cap being specified for use with different types of said first and second fluids having different viscosities, to obtain better mixing of said first and second fluids; and a fluid dispensing apparatus with a body assembly having first and second valves that are coupled to the first and second outlets of the metering mechanism and that feed first and second outlets positioned on a front face of the assembly to which first and second inlets of a selected one of the plurality of caps, respectively, are coupled and a removable plate to be positioned between the front face of the body assembly and the selected cap and on which first and second valve seats for the first and second valves, respectively, are formed.

20. The system of claim 19 wherein the metering mechanism and the fluid dispensing apparatus are to operate with one of the first fluid and the second fluid being one of an epoxy, silicone, polysulfide, and urethane.

21. The system of claim 20 wherein the metering mechanism and the fluid dispensing apparatus are to operate with the first fluid being a base and the second fluid being a catalyst that causes a reaction when mixed with the base.

22. The system of claim 21 wherein the metering mechanism and the fluid dispensing apparatus are to provide a mixture of the base and catalyst, said mixture being one of an adhesive and a sealant.

23. The system of claim 22 wherein the metering mechanism is to provide said metered flows through the first and second outlets at more than 1000 psi.

24. The system of claim 23 wherein the fluid dispensing apparatus further includes a handle coupled to the body assembly.

* * * * *